US008888247B2

(12) United States Patent
Niihara et al.

(10) Patent No.: US 8,888,247 B2
(45) Date of Patent: Nov. 18, 2014

(54) IMAGE FORMING APPARATUS INCLUDING RECORDING HEAD FOR EJECTING LIQUID DROPLETS

(75) Inventors: Takayuki Niihara, Kanagawa (JP); Shinichiro Naruse, Kanagawa (JP); Kenji Shimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 16 days.

(21) Appl. No.: 13/476,169

(22) Filed: May 21, 2012

(65) Prior Publication Data

US 2012/0306960 A1 Dec. 6, 2012

(30) Foreign Application Priority Data

Jun. 3, 2011 (JP) ..... 2011-124980
Sep. 15, 2011 (JP) ..... 2011-202264

(51) Int. Cl.

| | |
|---|---|
| ***B41J 2/14*** | (2006.01) |
| ***B41J 29/02*** | (2006.01) |
| ***B41J 25/34*** | (2006.01) |
| ***B41J 2/175*** | (2006.01) |

(52) U.S. Cl.

CPC ..... *B41J 2/1752* (2013.01); *B41J 29/02* (2013.01); *B41J 25/34* (2013.01)
USPC ..... 347/49

(58) Field of Classification Search

CPC ..... B41J 2/1752; B41J 2202/20
See application file for complete search history.

(56) References Cited

U.S. PATENT DOCUMENTS

| | | | |
|---|---|---|---|
| 6,336,698 | B1 | 1/2002 | Imai |
| 7,628,556 | B2 | 12/2009 | Naruse |
| 2004/0061911 | A1 | 4/2004 | Samoto |
| 2008/0231653 | A1 | 9/2008 | Kawashima et al. |
| 2011/0205299 | A1 | 8/2011 | Naruse et al. |
| 2012/0056936 | A1 | 3/2012 | Shimizu et al. |
| 2012/0062649 | A1 | 3/2012 | Naruse et al. |

FOREIGN PATENT DOCUMENTS

| | | | |
|---|---|---|---|
| CN | 1496855 | A | 5/2004 |
| CN | 101456304 | | 6/2009 |
| EP | 1777074 | B1 | 5/2009 |
| JP | 3376216 | B2 | 3/1997 |
| JP | 10-181150 | | 7/1998 |
| JP | 10-337862 | | 12/1998 |
| JP | 11-227283 | | 8/1999 |
| JP | 11-263005 | | 9/1999 |
| JP | 2001-138495 | | 5/2001 |
| JP | 2001-179951 | | 7/2001 |
| JP | 2001-334652 | | 12/2001 |
| JP | 2002-347300 | | 12/2002 |
| JP | 2007-216466 | | 8/2007 |
| JP | 2007-276289 | | 10/2007 |
| JP | 2010-30270 | | 2/2010 |
| JP | 2011-37235 | | 2/2011 |
| JP | 2011-56840 | | 3/2011 |

*Primary Examiner* — Justin Seo
(74) *Attorney, Agent, or Firm* — Cooper & Dunham LLP

(57) ABSTRACT

An image forming apparatus includes a recording head, a head holder, a carriage, a guide member, a reference member, and a pressing unit. The recording head has a plurality of nozzles to eject liquid droplets. The head holder holds the recording head. The carriage is reciprocally movable in a main scanning direction and holds the head holder. The guide member is disposed along the main scanning direction to guide the carriage along the main scanning direction. The reference member is disposed parallel to the guide member in the carriage to rotatably hold the head holder. The pressing unit presses the head holder toward the carriage. The head holder is pressed against the reference member and the carriage by the pressing unit.

15 Claims, 13 Drawing Sheets

IMAGE FORMING APPARATUS INCLUDING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application Nos. 2011-124980, filed on Jun. 3, 2011, and 2011-202264, filed on Sep. 15, 2011 in the Japan Patent Office, the entire disclosure of each of which is hereby incorporated by reference herein.

BACKGROUND

1. Technical Field

This disclosure relates to an image forming apparatus, and more specifically to an image forming apparatus including a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink.

When such a liquid-ejection type image forming apparatus forms an image on a recording medium, the accuracy with which liquid droplets ejected from nozzles are landed on target positions of the recording medium significantly affects image quality. Since a low level of the landing accuracy reduces image quality, the recording head need be positioned at high accuracy.

Meanwhile, if ejection failure occurs in the recording head, it is preferable that the recording head can be easily replaced at a user's site at which the apparatus is used. Even in such a case, the high degree of the positioning accuracy of the recording head must be reproduced at the user's site.

To enhance the positioning accuracy in replacing the recording head, for example, JP-2011-037235-A1 proposes an image forming apparatus including a head holder mounting liquid ejection heads and a carriage removably mounting the head holder. The head holder has positioning portions to contact positioning references in both the carriage scanning direction and the sheet conveyance direction, and the positioning portions serve as positioning references relative to the head holder of liquid ejection head.

However, for the image forming apparatus disclosed in JP-2011-037235-A1, the carriage of the head holder is positioned by positioning faces and pins, thus resulting in a complex configuration. In particular, in a case where the image forming apparatus has multiple head holders, the positioning portions need be provided for the respective head holders. Such a configuration makes it difficult to position the head holders relative to each other, thus hampering easy replacement of the recording head.

BRIEF SUMMARY

In an aspect of this disclosure, there is provided an image forming apparatus including a recording head, a head holder, a carriage, a guide member, a reference member, and a pressing unit. The recording head has a plurality of nozzles to eject liquid droplets. The head holder holds the recording head. The carriage is reciprocally movable in a main scanning direction and holds the head holder. The guide member is disposed along the main scanning direction to guide the carriage along the main scanning direction. The reference member is disposed parallel to the guide member in the carriage to rotatably hold the head holder. The pressing unit presses the head holder toward the carriage. The head holder is pressed against the reference member and the carriage by the pressing unit.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
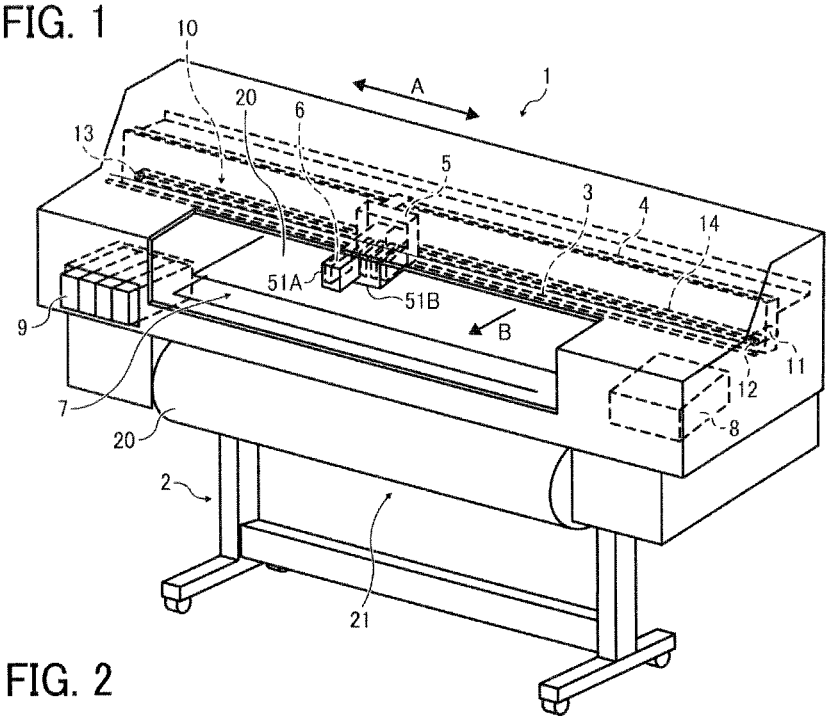
FIG. 1 is an external perspective view of an inkjet recording apparatus serving as an image forming apparatus according to an exemplary embodiment of the present disclosure.

The accompanying drawings are intended to depict exemplary embodiments of the present disclosure and should not be interpreted to limit the scope thereof The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "sheet" used herein is not limited to a sheet of paper but be, e.g., an OHP (overhead projector) sheet, a cloth sheet, a grass sheet, a substrate, or anything on which droplets of ink or other liquid can be adhered. In other words, the term "sheet" is used as a generic term including a recording medium, a recorded medium, a recording sheet, or a recording sheet of paper. The term "image forming apparatus" refers to an apparatus that ejects ink or any other liquid onto a medium to form images on the medium. The medium is made of, for example, paper, string, fiber, cloth, leather, metal, plastic, glass, timber, and ceramic. The term "image formation", which is used herein as a synonym for "recording" or "printing", includes providing not only meaningful images, such as characters and figures, but meaningless images, such as patterns, to the medium (in other words, the term "image formation" includes only causing liquid droplets to land on the medium).

The term "ink" as used herein is not limited to "ink" in a narrow sense unless specifically distinguished and includes any types of liquid useable for image formation, such as recording liquid, fixing solution, DNA sample, resist, pattern material, and resin.

The term "image" used herein is not limited to a two-dimensional image and includes, for example, an image applied to a three dimensional object and a three dimensional object itself formed as a three-dimensionally molded image.

The term "image forming apparatus" includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an inkjet recording apparatus serving as an example of an image forming apparatus according to an exemplary embodiment of this disclosure is described with reference to FIGS. 1 and 2.

Figure 2:
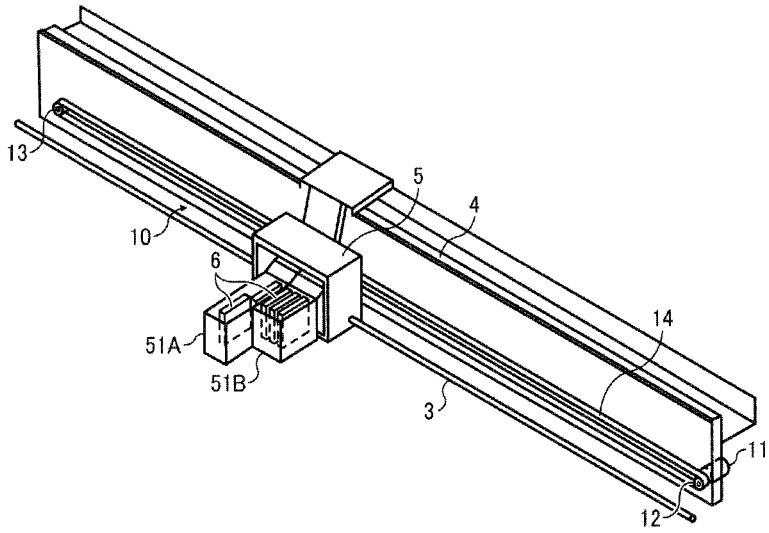
FIG. 2 is a perspective view of a carriage scanning unit of the image forming apparatus of FIG. 1.

FIG. 1 is a perspective view of the inkjet recording apparatus. FIG. 2 is a perspective view of a carriage scanning unit of the inkjet recording apparatus. In FIG. 1, the inkjet recording apparatus is a serial-type inkjet recording apparatus and has an apparatus body 1 and a support stand 2 to support the apparatus body 1.

The apparatus body 1 includes a guide rod 3 and a guide stay 4 serving as guide members extending between side plates. A carriage 5 is supported with the guide rod 3 and the guide stay 4 so as to be slidable along a direction indicated by an arrow A in FIG. 1.

On the carriage 5 are mounded recording heads 6 serving as liquid ejection heads for ejecting ink droplets of, for example, black (K), yellow (Y), magenta (M), and cyan (C). The recording heads 6 are integrally provided with head tanks that supply inks to the recording heads.

A main scanning unit 10 for moving the carriage 5 for scanning includes a driving motor 11 disposed at a first end in a main scanning direction, a driving pulley 12 rotated by the driving motor 11, a driven pulley 13 disposed at a second end opposite the first end in the main scanning direction, and a timing belt 14 serving as a dragging member wound around the driving pulley 12 and the driven pulley 13. A tension spring urges the driven pulley 13 outward (in a direction to move away from the driving pulley 12) to apply tension to the timing belt.

In a recording area of a main scanning region of the carriage 5, an aspiration conveyance unit 7 intermittently conveys a sheet 20 in a direction (sub-scanning direction or sheet conveyance direction) indicated by an arrow B in FIG. 1.

At the first end side of the main scanning region is disposed a maintenance-and-recovery unit 8 to maintain and recover good conditions of the recording heads 6. Outside a movement range of the carriage 5 in the main scanning direction or at the second end side of the main scanning region of the carriage 5, main cartridges 9 are removably mounted to the apparatus body 1 to store the respective color inks to be supplied to sub tanks (head tanks) of the recording heads 6.

In FIG. 1, a roll sheet (hereinafter, "sheet") 20 is set on a sheet feeder 21. It is to be noted that a roll sheet of a different width can be set on the sheet feeder 21. The sheet 20 fed from the sheet feeder 21 is conveyed with a conveyance device from a rear side to a front side of the apparatus to arrive at the recording area. While moving the carriage 5 in the main scanning direction and intermittently conveying the sheet 20 with the aspiration conveyance unit 7, the inkjet recording apparatus drives the recording heads 6 in accordance with image information to eject droplets from the recording heads 6, thus forming a desired image on the sheet 20. After image formation, the sheet 20 is cut at a predetermined length and discharged to a discharge tray at the front side of the apparatus body 1.

Next, an inkjet recording apparatus according to a first exemplary embodiment of this disclosure is described with reference to FIGS. 3 and 4.

Figure 3:
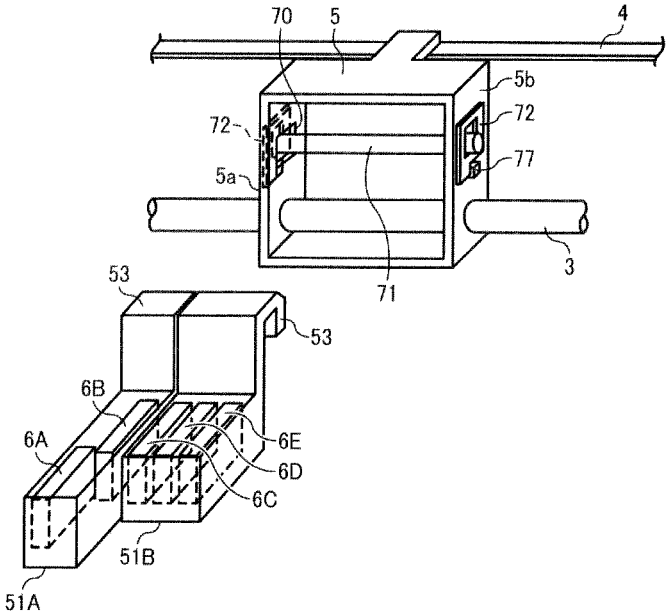
FIG. 3 is a schematic perspective view of a carriage section in a first exemplary embodiment of this disclosure before head holders are mounted on a carriage.
Figure 4:
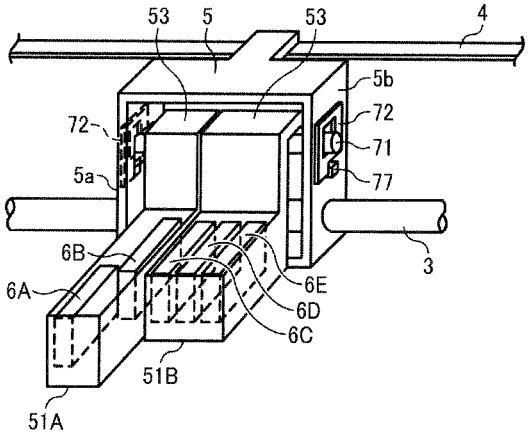
FIG. 4 is a schematic perspective view of the carriage section with the head holders mounted on the carriage.

FIG. 3 is a schematic perspective view of a carriage section in the first exemplary embodiment before head holders are mounted on a carriage. FIG. 4 is a perspective view of the carriage section with the head holders mounted on the carriage.

A head holder 51A for black and a head holder 51B for other colors are mounted on the carriage 5.

The head holder 51A holds two recording heads 6A and 6B for ejecting droplets of black ink. On the head holder 51A, the recording heads 6A and 6B are offset from each other in the sub-scanning direction. The head holder 51B holds three recording heads 6C, 6D, and 6E for ejecting ink droplets of, e.g., yellow, magenta, and cyan. The recording heads 6C, 6D, and 6E are arranged so as to have the same position as the recording head 6B in the sub-scanning direction. As described above, the recording heads 6A, 6B, 6C, 6D, and 6E are referred to as "recording heads 6" unless distinguished. It is to be noted that each of the head holders 51A and 51B may hold a single recording head 6.

In the carriage 5, a reference shaft member 71 serving as a reference member is disposed parallel to the guide rod 3. Each of the head holders 51A and 51B (hereinafter, referred to as "head holders 51" unless distinguished) has a hook portion 53 removably hooked on the reference shaft member 71. The head holders 51A and 51B are held by the carriage 5 with the hook portion 53 hooked on the reference shaft member 71. It is to be noted that the reference shaft member 71 may be cylindrical or polygonal.

As described above, arranging the reference shaft member 71 in parallel to the guide member 3 of the carriage 5 enhances the positional accuracy of inclination in the sub-scanning direction, the height direction, the tilt direction, and the main scanning direction.

Next, a structure for holding the reference shaft member relative to the carriage is described with reference to FIGS. 5 and 6.

Figure 5:
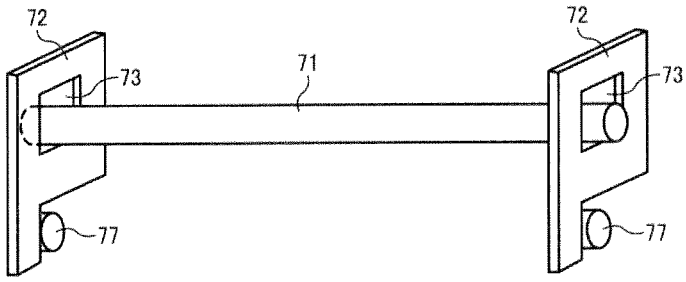
FIG. 5 is a perspective view of a structure for holding a reference shaft member relative to the carriage in the first exemplary embodiment.

FIG. 5 is a perspective view of the structure for holding the reference shaft member relative to the carriage 5. FIG. 6 is a front view of a position adjuster.

The reference shaft member 71 is inserted, with play, into through holes 70 (see FIG. 3) of side faces 5*a* and 5*b* of the carriage 5 in the main scanning direction, and held by position adjusters 72 fixed on outer surfaces of the side faces 5*a* and 5*b* of the carriage 5.

Figure 6:
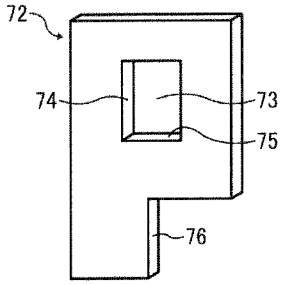
FIG. 6 is a perspective view of a position adjuster in the first exemplary embodiment.

As illustrated in FIG. 6, the position adjusters 72 are plate members and have positioning through holes 73 of, e.g., a rectangular shape through which the reference shaft member 71 passes. An inner wall face of the position adjuster 72 at the downstream side in the sub-scanning direction forms an edge of the positioning through hole 73 and serves as a positioning face 74 to position the reference shaft member 71 in the sub-scanning direction. Another inner wall face of the position adjuster 72 at a lower side in a height direction perpendicular to the positioning face 74 forms another edge of the positioning through hole 73 and serves as a positioning face 75 to position the reference shaft member 71 with respect to the height direction.

The position adjuster 72 has a cutout portion in the height direction. A wall face of the cutout portion in the vertical direction serves as a positioning face 76 to position the position adjuster 72 in the rotation direction with the reference shaft member 71 contacting the positioning faces 74 and 75, i.e., fix the position of the position adjuster 72 in the rotation direction. The positioning face 76 of the position adjuster 72 contacts a rotation stopper 77 of each of the side faces 5*a* and 5*b* of the carriage 5.

As described above, the position adjusters 72 are disposed at both ends of the reference shaft member 71. Such a configuration can secure a maximum distance for positional adjustment, thus allowing the reference shaft member 71 to be positioned at high accuracy. In addition, two inner edges of the position adjuster 72 for positioning the reference shaft member 71 in both the height direction and the sub-scanning direction are arranged perpendicular to each other. Such a configuration allows the reference shaft member 71 to be positioned in a corner-contact manner, thus allowing highly accurate positioning. Furthermore, by arranging the position adjusters 72 in parallel to each other, the height, sub-scanning position, and inclination of both ends of the reference shaft member 71 can be determined by the same shape for corner contact, thus allowing highly accurate positioning and cost reduction.

Next, the direction in which the reference shaft member 71 is pressed against the position adjusters 72 is described with reference to FIG. 7.

Figure 7:
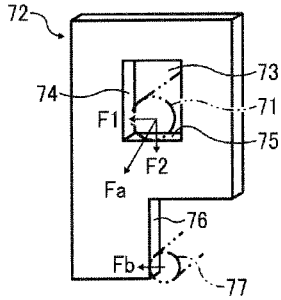
FIG. 7 is a perspective view of the reference shaft member pressed against the position adjuster in the first exemplary embodiment.

FIG. 7 is a perspective view of the position adjuster to hold the reference shaft member 71.

By applying a pressing force acting in a direction indicated by an arrow Fa to the reference shaft member 71, the reference shaft member 71 contacts the positioning faces 74 and 75, thus creating forces divided in two directions indicated by arrows F1 and F2 in FIG. 7. As a result, the reference shaft member 71 is positioned in both the sub-scanning direction and the height direction. In addition, by applying a pressing force acting in a direction indicated by an arrow Fb relative to the reference shaft member 71, the positioning face 76 of each position adjuster 72 is pressed against the rotation stopper 77 at each of the side faces 5*a* and 5*b* of the carriage 5, thus fixing the position of each position adjuster 72 in the rotation direction.

In such a case, for example, an elastic member, such as a spring or a rubber member, may be used to apply the pressing force to the reference shaft member 71 directly or via the head holders 51A and 51B.

As described above, pressing the reference shaft member 71 against the positioning faces of the position adjusters 72 in the sub-scanning direction and the height direction allows the reference shaft member 71 to be reliably pressed against the same faces and places, thus allowing highly accurate positioning.

In this exemplary embodiment, in replacing, e.g., the recording heads 6A and 6B of the head holder 51A, the head holder 51A is removed from the reference shaft member 71. After replacing the recording heads 6A and 6B, the head holder 51A is hooked on and held by the reference shaft member 71 again.

Such a configuration can reproduce the positional accuracy of the recording heads 6 of the head holder 51 (in the above-described example, the head holder 51A) after replacement while obtaining a high degree of the positional accuracy of the recording heads 6 of the other head holder 51 (in the above-described example, the head holder 51B) not replaced.

As described above, the image forming apparatus according to this exemplary embodiment has one or more recording heads having nozzles to eject liquid droplets, one or more head holders to hold the one or more recording heads, a carriage reciprocally movable in a main scanning direction and holding the one or more head holders, a guide member arranged along the main scanning direction to guide the carriage along the main scanning direction, and a reference member disposed parallel to the guide member in the carriage. The one or more head holders are removably hooked on and supported by the reference member. Such a configuration allows the recording heads to be positioned at high accuracy, thus facilitating replacement of the recording heads.

Alternatively, the image forming apparatus may have a plurality of head holders and a reference member disposed along a direction in which recording heads are arranged. The plurality of head holders is removably held by the reference member. In other words, like a line-head-type image forming apparatus, holding the plurality of head holders on the common reference member enhances the mounting accuracy of the plurality of recording heads. As a result, the recording heads can be easily positioned relative to each other at high accuracy, thus facilitating replacement of the recording heads.

It is to be noted that, in a case where the reference member is positioned at high accuracy, each head holder may hold a single recording head.

Next, a second exemplary embodiment of the present disclosure is described with reference to FIGS. 8 to 11.

Figure 8:
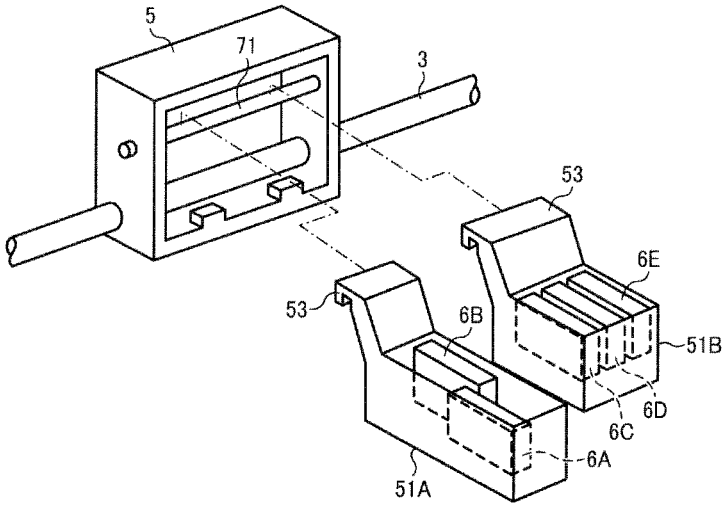
FIG. 8 is a schematic perspective view of a carriage section in a second exemplary embodiment of this disclosure before head holders are mounted on a carriage.
Figure 9:
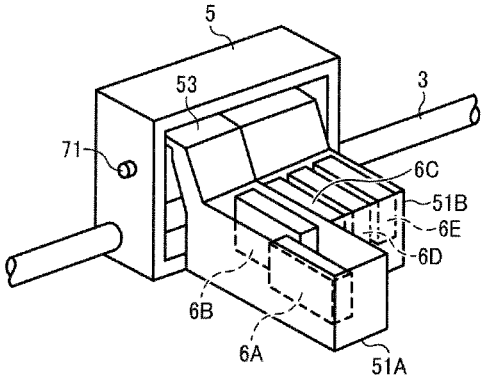
FIG. 9 is a schematic perspective view of the carriage section in the second exemplary embodiment with the head holders mounted on the carriage.
Figure 10:
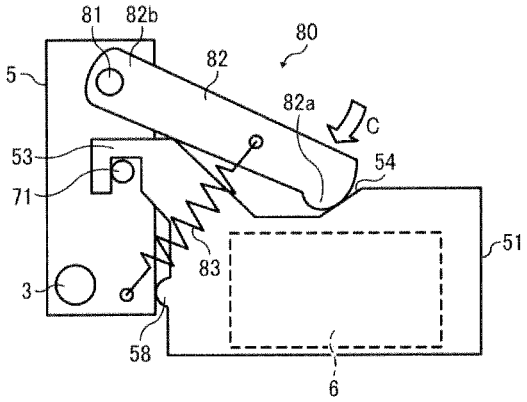
FIG. 10 is a side view of the carriage section and a pressing structure in the second exemplary embodiment.
Figure 11:
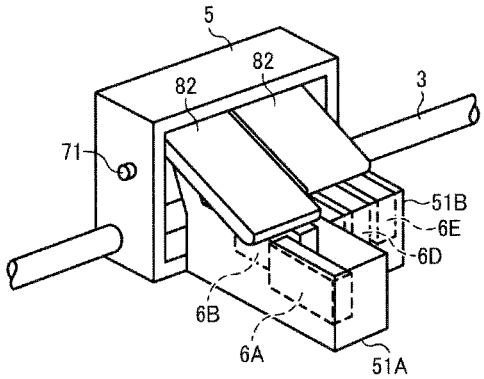
FIG. 11 is a schematic perspective view of the carriage section in the second exemplary embodiment with pressing members mounted on the carriage.

FIG. 8 is a schematic perspective view of a carriage section in the second exemplary embodiment before a head holder is mounted on a carriage. FIG. 9 is a schematic perspective view of the carriage section with the head holder mounted on the carriage. FIG. 10 is a side view of the carriage section and a pressing structure. FIG. 11 is a schematic perspective view of the carriage section with pressing members mounted on the carriage.

In this exemplary embodiment, like the first exemplary embodiment, a reference shaft member 71 serving as a reference member is disposed in a carriage 5 and parallel to a guide rod 3. Each of head holders 51A and 51B has a hook portion 53 removably hooked on the reference shaft member 71. The head holders 51A and 51B are rotatably held by the carriage 5 with the hook portion 53 hooked on the reference shaft member 71.

As illustrated in FIG. 10, each of the head holder 51A and 51B has at least one convex portion 58 serving as a contact portion to contact the carriage 5. In FIGS. 8 to 11, each of the head holders 51A and 51B has a single hook portion 53 in the main scanning direction. It is to be noted that each head holder may have a plurality of hook portions and, for example, hooked portions 53 may be disposed at both ends of each head holder in the main scanning direction.

Here, as illustrated in FIG. 10, the head holder 51A has a slant face 54 at the upper side of both ends.

A pressing mechanism 80 serving as a pressing unit is arranged to press the head holders 51 in such a direction that the head holders 51 rotate around the reference shaft member 71 toward the carriage 5.

The pressing mechanism 80 has pressing members 82 having rear end portions 82*b* rotatably supported by the carriage 5 via a shaft 81. The pressing members 82 are, for example, flat plate members as illustrated in FIG. 11. The pressing member 82 has a front end portion 82*a* to contact the slant face 54 of the head holder 51 from above. An elastic member 83, such as an extension coil spring, is disposed between each pressing member 82 and the carriage 5. By an urging force of the elastic member 83, the front end portion 82*a* of each pressing member 82 presses (pushes) the slant face 54 of the head holder 51 in a direction indicated by an arrow C.

As a result, the head holder 51 is urged by the pressing member 82 so as to rotate in a clockwise direction indicated by the arrow C in FIG. 10 around the reference shaft member 71. Thus, since the head holder 51 is pressed against the reference shaft member 71 and the carriage 5, the positions of the head holders 51A and 51B are determined. In other words, by hooking the head holder 51 on the reference shaft member 71 and applying a pressing force to one point, the head holder 51 can be simply positioned.

As a result, even in a case where recording heads are replaced at a user's site, the recording heads can be positioned at high accuracy, thus facilitating replacement of the recording heads.

As described above, the image forming apparatus according to this exemplary embodiment has one or more recording heads, one or more head holders to hold the one or more recording heads, a carriage reciprocally movable in a main scanning direction and holding the one or more head holders, a guide member disposed along the main scanning direction to guide the carriage along the main scanning direction, a reference member disposed parallel to the guide member in the carriage to rotatably hold the one or more head holders, and a pressing unit to press the one or more head holders toward the carriage. The one or more head holders are pressed against both the reference member and the carriage by the pressing unit. Such a configuration allows the recording heads to be positioned at high accuracy, thus facilitating replacement of the recording heads.

In addition, as described above, the hook portions 53 may be disposed at both ends of each head holder 51 in the main scanning direction, and each head holder 51 may contact the carriage 5 at one point, i.e., the convex portion 58. Thus, by positioning the head holder 51 at three points, a clearance between the recording heads 6 and the sheet 20 can be maintained at high accuracy.

Furthermore, holding the head holder 51 by the shaft member (the reference shaft member 71 in this exemplary embodiment) can minimize variations in components. Using a spring member, such as an extension coil spring, as the urging member to urge the pressing member allows cost reduction.

Here, different examples of the structure for hooking the head holder on the reference shaft member are described with reference to FIGS. 12A to 12C and FIGS. 13A and 13B.

FIGS. 12A to 12C and FIGS. 13A and 13B are enlarged views of different examples of the structure for hooking the head holder on the reference shaft member.

Figure 12A:
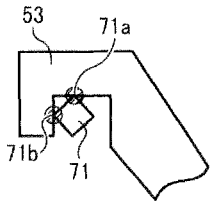
FIGS. 12A to 12C are enlarged views of different examples of a structure for hooking the head holder on the reference shaft member.

For a first example illustrated in FIG. 12A, the hook portion 53 of the head holder 51 has a rectangular shape with a lower side (edge) open, and the reference shaft member 71 has a rectangular cross section in a direction perpendicular to the axial direction. The hook portion 53 and the reference shaft member 71 are arranged so that two edges of the hook portion 53 of the head holder 51 contact two corners 71*a* and 71*b* of the reference shaft member 71. The contact points of the hook portion 53 with the reference shaft member 71 are indicated by hatched circles in FIG. 12A.

Figure 12B:
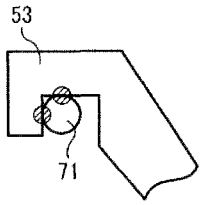
Figure 12C:
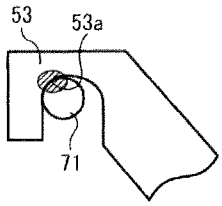

For a second example illustrated in FIG. 12B, the hook portion 53 of the head holder 51 has a rectangular shape with a lower side (edge) open, and the reference shaft member 71 has a circular cross section in a direction perpendicular to the axial direction. The hook portion 53 and the reference shaft member 71 are arranged so that two edges of the hook portion 53 of the head holder 51 contact two points of the circumferential surface of the reference shaft member 71. The contact points of the hook portion 53 with the reference shaft member 71 are indicated by hatched circles in FIG. 12B For a third example illustrated in FIG. 12C, the hook portion 53 of the head holder 51 has an arc surface 53*a*, and the reference shaft member 71 has a circular cross section in a direction perpendicular to the axial direction. The hook portion 53 and the reference shaft member 71 are arranged so that the arc surface 53*a* of the hook portion 53 of the head holder 51 contacts the circumferential surface of the reference shaft member 71. The contact point of the hook portion 53 with the reference shaft member 71 is indicated by a hatched circle in FIG. 12C.

In a case where the reference shaft member 71 has a rectangular shape as in the first example, the contact state of the reference shaft member 71 with the head holder 51 may vary depending on the angle at which the reference shaft member 71 is mounted in the carriage 5. By contrast, in a case where the reference shaft member 71 has a cylindrical shape as in the second and third examples, the mount angle of the reference shaft member 71 less affects the contact state of the reference shaft member 71 with the head holder 51, thus more stably positioning the head holder 51A than in the first example.

Figure 13A:
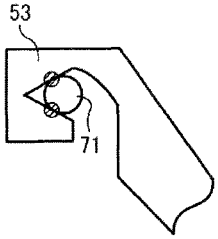
FIGS. 13A and 13B are enlarged views of different examples of the structure for hooking the head holder on the reference shaft member.

For a fourth example illustrated in FIG. 13A, the hook portion 53 of the head holder 51 has a triangle shape with a side (edge) proximal to the recording head open, in a cross section in a direction perpendicular to the axial direction of the reference shaft member 71. The reference shaft member 71 has a circular cross section in the direction perpendicular to the axial direction. The hook portion 53 and the reference shaft member 71 are arranged so that two edges of the hook portion 53 of the head holder 51 contact the circumferential surface of the reference shaft member 71. The contact points of the hook portion 53 with the reference shaft member 71 are indicated by hatched circles in FIG. 13A.

Figure 13B:
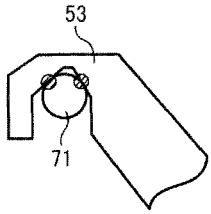

For a fifth example illustrated in FIG. 13B, the hook portion 53 of the head holder 51 has a trapezoid shape with a lower side (edge) open, in a cross section in a direction perpendicular to the axial direction of the reference shaft member 71. The reference shaft member 71 has a circular cross section in the direction perpendicular to the axial direction. The hook portion 53 and the reference shaft member 71 are arranged so that two edges of the hook portion 53 of the head holder 51 contact the circumferential surface of the reference shaft member 71. The contact points of the hook portion 53 with the reference shaft member 71 are indicated by hatched circles in FIG. 13B.

As described in the fourth example and the fifth example, the hook portion 53 of the head holder 51 contacts the reference shaft member 71 at two points, thus allowing stable positioning of the head holder 51A.

Next, different examples of the pressing mechanism are described with reference to FIGS. 14 and 15.

Figure 14:
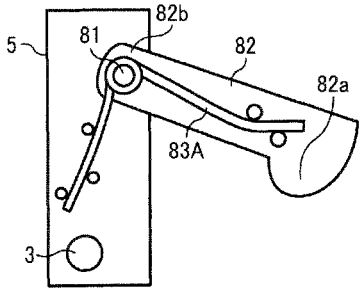
FIG. 14 is a side view of another example of the pressing structure.
Figure 15:
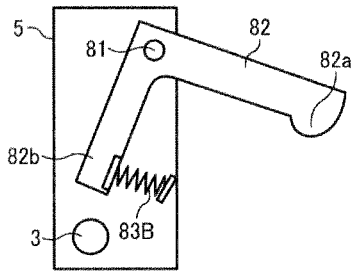
FIG. 15 is a side view of still another example of the pressing structure.

FIGS. 14 and 15 are side views of different examples of the pressing mechanism. A first example illustrated in FIG. 14 employs a torsion spring 83A as the urging member to urge the pressing member 82.

For a second example illustrated in FIG. 15, the pressing member 82 has an L-shape and a compression coil spring 83B is employed as the urging member to urge the pressing member 82.

Such configurations also allow application of the pressing force to the head holder at relatively low cost.

Next, a third exemplary embodiment is described with reference to FIG. 16.

Figure 16:
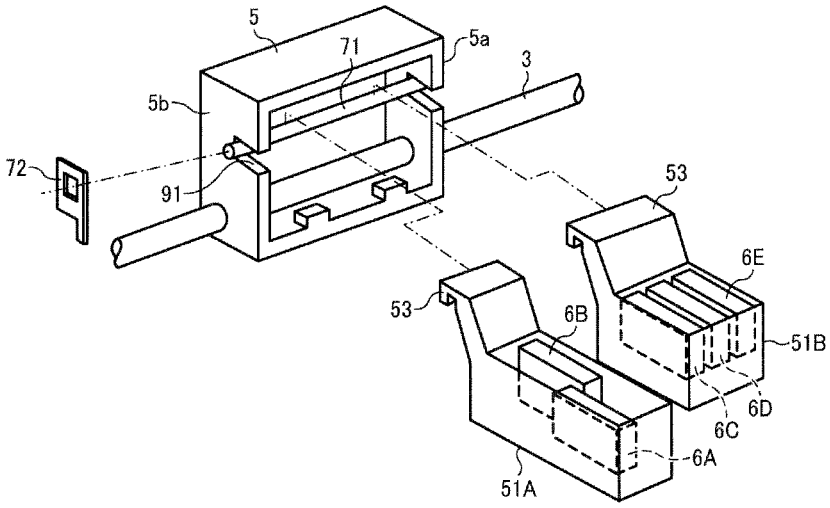
FIG. 16 is an exploded perspective view of a carriage section in a third exemplary embodiment of this disclosure.

FIG. 16 is an exploded perspective view of a carriage section in the third exemplary embodiment. In this exemplary embodiment, the carriage 5 has recessed portions 91 at side walls 5*a* and 5*b*, and the reference shaft member 71 is removably inserted in the recessed portions 91. In such a case, both end portions of the reference shaft member 71 in the axial direction are supported by the carriage 5 with the position adjusters 72.

Next, a fourth exemplary embodiment of the present disclosure is described with reference to FIGS. 17 to 20.

Figure 17:
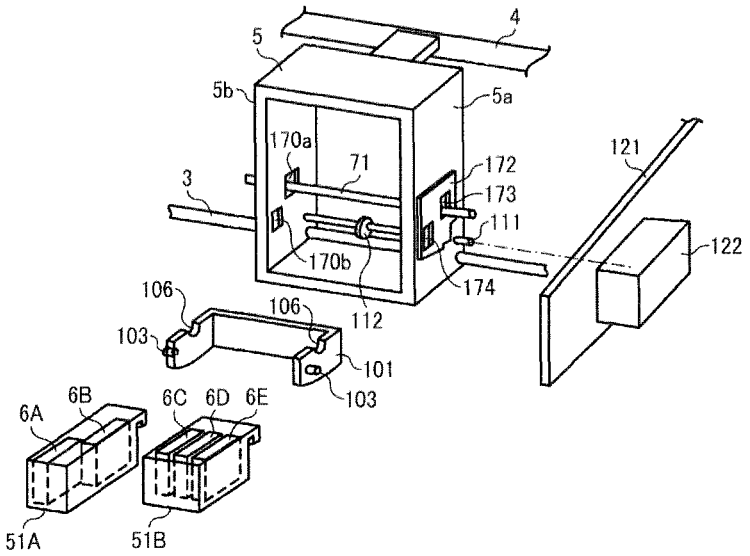
FIG. 17 is an exploded perspective view of a carriage section in a fourth exemplary embodiment of this disclosure.
Figure 18:
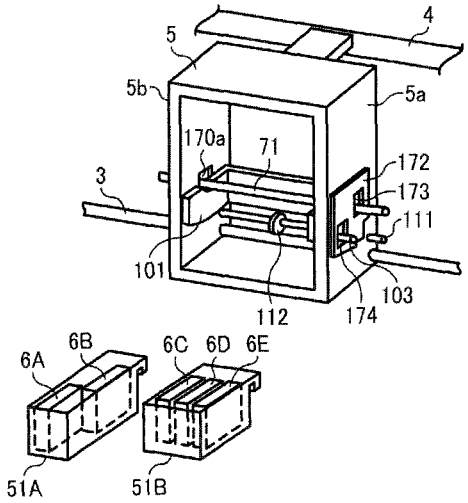
FIG. 18 is a schematic perspective view of the carriage section in the fourth exemplary embodiment with an intermediate member mounted on a carriage.
Figure 19:
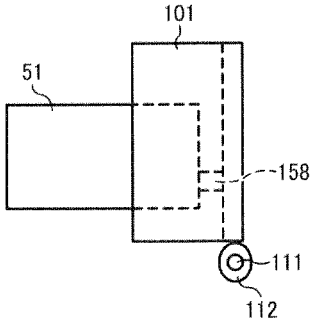
FIG. 19 is a schematic side view of the intermediate member and a head holder section in the fourth exemplary embodiment.
Figure 20:
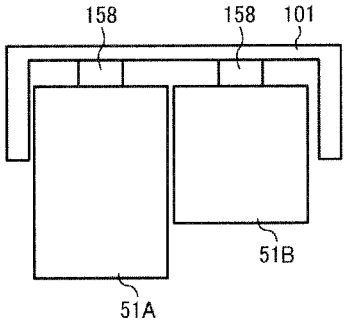
FIG. 20 is a schematic plan view of the intermediate member and the head holder section in the fourth exemplary embodiment.

FIG. 17 is a schematic exploded perspective view of a carriage section in the fourth exemplary embodiment. FIG. 18 is a schematic perspective view of the carriage section with an intermediate member mounted. FIG. 19 is a schematic side view of the intermediate member and a head holder section. FIG. 20 is a schematic plan view of the intermediate member and the head holder section.

In this exemplary embodiment, the reference shaft member 71 pass through two through holes 170*a* of side walls 5*a* and 5*b* of the carriage 5 in the main scanning direction, and held by position adjusters 172 mounted on outer wall faces of the side walls 5*a* and 5*b* of the carriage 5. Each of the position adjusters 172 has a positioning through hole 173 forming positioning faces of the reference shaft member 71.

Here, the positioning through holes 173 also serve as guide holes to guide the reference shaft member 71 when the reference shaft member 71 moves up and down, and the reference shaft member 71 is supported by the through holes 173 so as to be movable up and down.

In this exemplary embodiment, an intermediate member 101 is disposed between the reference shaft member 71 and the head holders 51A and 51B.

At both end portions of the intermediate member 101 are disposed support shaft members 103 parallel to the reference shaft member 71. The support shaft members 103 pass through respective through holes 170*b* and are supported by support holes 174 of the position adjusters 172. The intermediate member 101 also has recessed portions 106, and the reference shaft member 71 fits in the recessed portions 106. The support holes 174 of the position adjusters 172 also serve as guide holes to guide the support shaft members 103 when the support shaft members 103 move up and down. The support shaft members 103 are supported by the support holes 174 so as to be movable up and down.

As illustrated in FIGS. 19 and 20, a convex portion 158 serving as a contact portion is disposed at a side of each of the head holders 51A and 51B proximal to the intermediate member 101 to surface-to-surface contact a wall face of the intermediate member 101.

At a lower side of the intermediate member 101, an elevation rod 111 is rotatably held by the carriage 5. At least one elevation cam 112 is mounted on the elevation rod 111 so as to be able to contact a lower surface of the intermediate member 101. As illustrated in FIG. 17, one end portion of the elevation rod 111 is rotated by an elevation motor 122 mounted on a side plate 121 of the apparatus body.

Next, elevating operation of the head holders 51A and 51B is described with reference to FIGS. 21A and 21B.

Figure 21A:
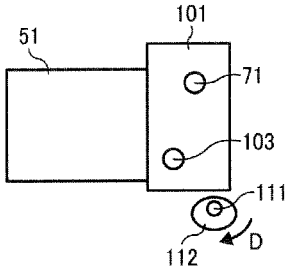
FIGS. 21A and 21B are schematic side views of the intermediate member and the head holder section in the fourth exemplary embodiment.
Figure 21B:
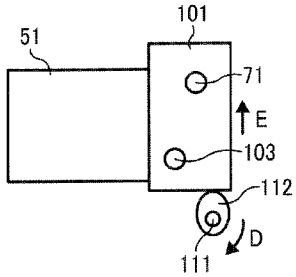

As illustrated in FIG. 21A, in a state in which the elevation cam 112 does not contact the intermediate member 101, the elevation cam 112 takes an initial height position. From the state, for example, by rotating the elevation cam 112 in a direction indicated by an arrow D in FIG. 21A, the elevation cam 112 contacts the intermediate member 101 to push the intermediate member 101 up in a direction indicated by an arrow E. As a result, when the intermediate member 101 displaces (moves) upward, the head holder 51 moves away from a recording face of the sheet 20.

As described above, since the height position of the head holder 51 can be adjusted by displacing the intermediate member 101, the size of the clearance between the sheet 20 and the recording heads 6 of the head holders 51A and 51B can be adjusted. In such a configuration, by displacing the intermediate member, rather than moving the entire carriage to adjust, the height positions of the recording heads are adjusted, thus facilitating adjustment of the clearance size with a simple configuration.

Next, a fifth exemplary embodiment of the present disclosure is described with reference to FIG. 22.

Figure 22:
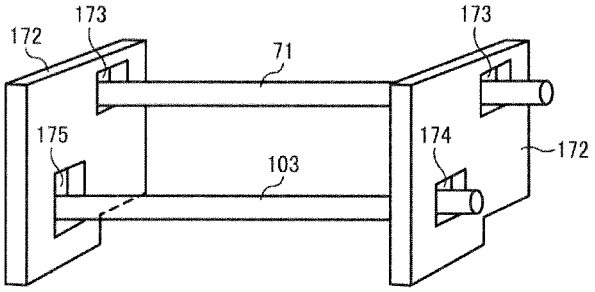
FIG. 22 is a perspective view of a reference shaft member and a support shaft portion of an intermediate member in a fifth exemplary embodiment of this disclosure.

FIG. 22 is a perspective view of a reference shaft member and a support shaft portion of an intermediate member in the fifth exemplary embodiment. In this exemplary embodiment, a support shaft member 103 is disposed so as to pass through an intermediate member 101, and the intermediate member 101 is held by position adjusters 172 mounted on a carriage 5.

A reference shaft member 71 is positioned by contacting both end portions of the reference shaft member 71 with wall faces of positioning through holes 173 of the position adjusters 172. One end portion of the support shaft member 103 contacts and is supported by a wall face of a support hole 174 of a corresponding one of the position adjusters 172. By contrast, the opposite end portion of the support shaft members 103 passes through a through hole 175 of the other one of the position adjusters 172 without contacting the through hole 175.

Next, a sixth exemplary embodiment of the present disclosure is described with reference to FIG. 23.

Figure 23:
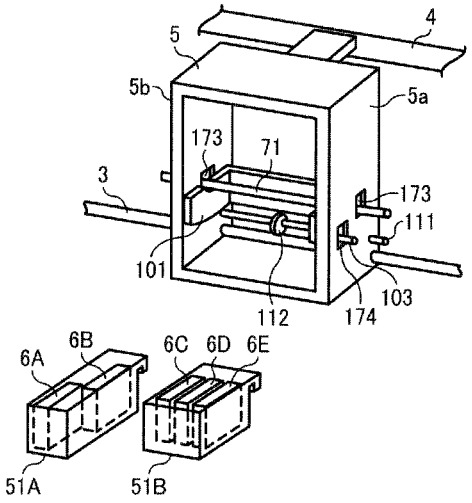
FIG. 23 is a schematic perspective view of a carriage section in a sixth exemplary embodiment of this disclosure.

FIG. 23 is an exploded perspective view of a carriage section in the sixth exemplary embodiment. This exemplary embodiment differs from the fourth exemplary embodiment in that a reference shaft member 71 and support shaft members 103 are supported directly by a carriage 5. Except for the difference, the sixth exemplary embodiment has substantially the same configuration as that of the fourth exemplary embodiment.

Next, a structure for pressing head holders in a seventh exemplary embodiment is described with reference to FIGS. 24 and 25.

Figure 24:
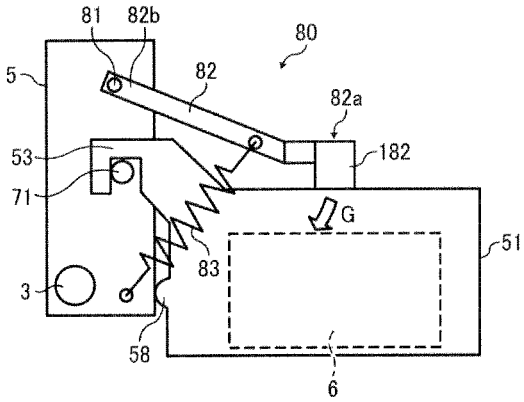
FIG. 24 is a side view of a carriage section and a pressing structure in a seventh exemplary embodiment.

FIG. 24 is a side view of a carriage section and the pressing structure. FIG. 25 is a schematic perspective view of the carriage section with pressing members mounted on a carriage.

As illustrated in FIG. 24, each of head holders 51A and 51B has at least one convex portion 58 serving as a contact portion to contact a carriage 5. In FIGS. 24 and 25, each of the head holders 51A and 51B has a single hook portion 53 in the main scanning direction. It is to be noted that each head holder may have a plurality of hook portions, and for example, hooked portions 53 may be disposed at both ends of each head holder in the main scanning direction.

A pressing mechanism 80 serving as a pressing unit is arranged to press the head holders 51 in such a direction that the head holders 51 rotate around a reference shaft member 71 toward the carriage 5.

The pressing mechanism 80 has a pressing member 82 having a rear end portion 82*b* rotatably supported by the carriage 5 via a shaft 81. The pressing member 82 is, for example, a substantially-flat plate member as illustrated in FIG. 25.

Figure 25:
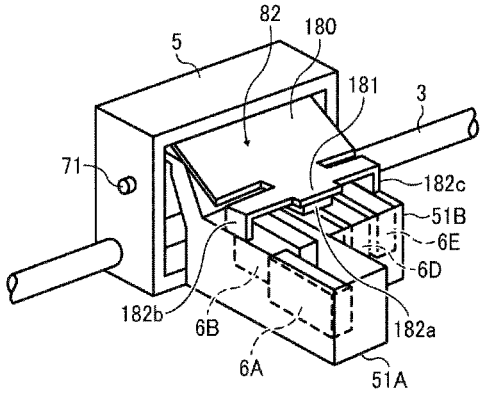
FIG. 25 is a schematic perspective view of the carriage section in the seventh exemplary embodiment with a pressing member mounted on a carriage.

In FIG. 25, the single pressing member 82 serving as a cover member covers the head holders 51A and 51B. It is to be noted that two pressing members may be provided so as to press and cover the respective head holders 51A and 51B.

At the front end side 82*a*, the pressing member 82 has pressing portions 182 (182*a* to 182*c* described below) to contact the head holders 51 from above. An elastic member 83, such as an extension coil spring, is disposed between the pressing member 82 and the carriage 5. By the elastic tensile force of the elastic member 83, the pressing portions 182 of the pressing member 82 press (push) the head holders 51 in a direction indicated by an arrow G.

As a result, the head holders 51 is urged by the pressing member 82 so as to rotate in a clockwise direction indicated by the arrow G in FIG. 24 around the reference shaft member 71. Thus, since the head holder 51 is pressed against the reference shaft member 71 and the carriage 5, the head holders 51A and 51B are positioned. In other words, the head holder 51 can be simply positioned by hooking the head holder 51 on the reference shaft member 71 and closing the pressing member 82 (i.e., covering an area above the head holder 51).

As a result, even in a case where recording heads are replaced at a user's site, the recording heads can be positioned at high accuracy, thus facilitating replacement of the recording heads.

Figure 27:
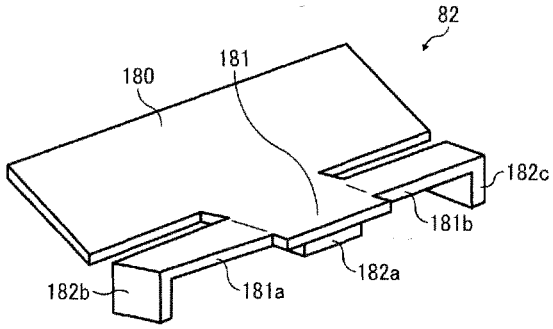
FIG. 27 is a perspective view of the pressing member in the seventh exemplary embodiment.
Figure 28:
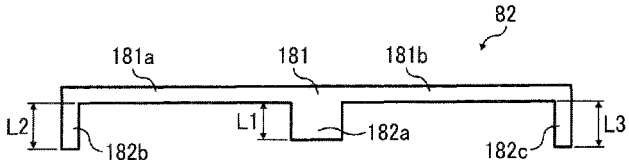
FIG. 28 is a front view of the pressing member in the seventh exemplary embodiment in a state in which the pressing member does not press the head holder.

Next, the pressing member 82 is further described with reference to FIGS. 26 to 28.

Figure 26:
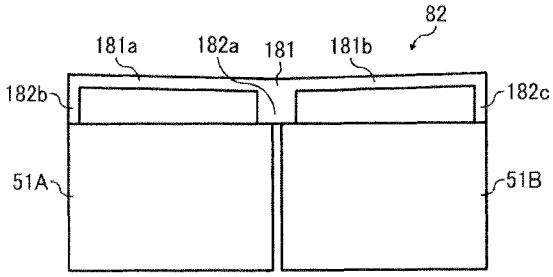
FIG. 26 is a front view of a head holder and the pressing member in the seventh exemplary embodiment in a state in which the head holder is pressed by the pressing member.

FIG. 26 is a front view of the head holder and the pressing member in a state in which the head holder is pressed by the pressing member. FIG. 27 is a perspective view of the pressing member. FIG. 28 is a front view of the pressing member in a state in which the pressing member does not press the head holder.

The pressing member 82 has a cover part 180 and a pressing part 181. The cover part 180 covers an area above and opposes the head holders 51A and 51B, and the pressing part 181 has the pressing portions 182*a* to 182*c*. In the pressing part 181, the three pressing portions 182*a* to 182*c* are arranged along a moving direction of the carriage 5.

The pressing portion 182*a* presses end portions of the head holders 51A and 51B adjacent to each other in the main scanning direction. The pressing portions 182*b* and 182*c* press respective end portions of the head holders 51A and 51B away from each other in the main scanning direction.

The pressing part 181 has arm portions 181*a* and 181*b* extending from a central portion having the pressing portion 182*a* toward both ends in the moving direction of the carriage 5. The arm portions 181*a* and 181*b* are made of bendable material, and the pressing portions 182*b* and 182*c* are disposed at respective outer ends of the arm portions 181*a* and 181*b*.

In a state in which the pressing portions 182*a* to 182*c* do not press the head holders 51A and 51B, the pressing portions 182*b* and 182*c* at both ends more protrude toward the head holders than the pressing portion 182*a* at the middle portion. In other words, as illustrated in FIG. 28, the distances L2 and L3 from the top to the bottom of the pressing portions 182*b* and 182*c* at both sides are longer than the distance L1 from the top to the bottom of the pressing portion 182*a* at the middle portion (L2>L1, and L3>L1). In addition, the distance L2 may be equal to the distance L3 (L2=L3).

As described above, the pressing member 82 has the three pressing portions 182*a* to 182*c* to press the head holders 51A and 51B. When the pressing portions 182*b* and 182*c* at both ends in the moving direction of the carriage 5 press the head holders 51A and 51B, the pressing portions 182*b* and 182*c* can displace. Meanwhile, when the pressing portion 182*a* at the middle portion presses the head holders 51A and 51B, the pressing portion 182*a* displaces at an amount smaller than each of the pressing portions 182*b* and 182*c*. The pressing portion 182*a* at the middle portion has a stiffness capable of displacing with displacement of the entire pressing member 82.

The pressing member 82 is, e.g., an elastic molded resin or a metal plate.

As described above, the pressing member 82 has at least one displaceable pressing portion, thus reliably pressing the head holders.

Next, an eighth exemplary embodiment of this disclosure is described with reference to FIG. 29.

Figure 29:
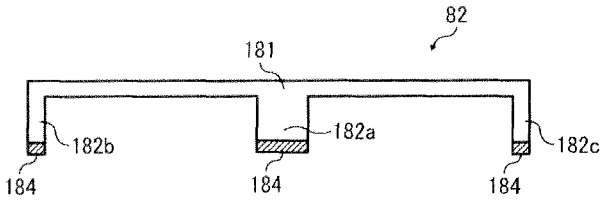
FIG. 29 is a schematic front view of a pressing member in an eighth exemplary embodiment.

FIG. 29 is a schematic front view of a pressing member in the eighth exemplary embodiment.

In this exemplary embodiment, elastic members 184 are disposed at positions at which the pressing portions 182*a* to 182*c* of the pressing member 82 contact the head holders 51A and 51B. The elastic members 184 may be, for example, springs, molds, or sponges. Such a configuration can more reliably press the head holder.

Next, a ninth exemplary embodiment of the present disclosure is described with reference to FIG. 30.

Figure 30:
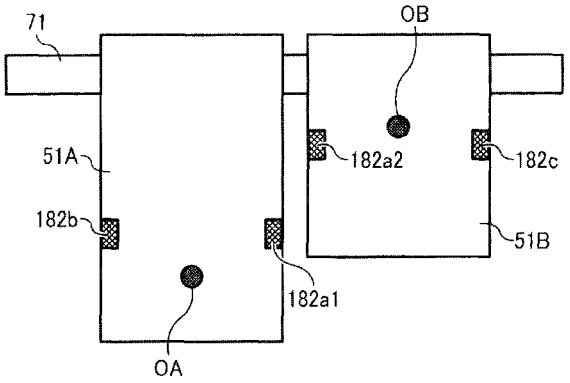
FIG. 30 is a schematic plan view of centroids and pressed points of head holders in a ninth exemplary embodiment.

FIG. 30 shows centroids and pressed points of head holders in the ninth exemplary embodiment.

In this exemplary embodiment, one pressing member 82 contacts a head holder 51A with a pressing portion 182*a*1 and a pressing portion 182*b*. Meanwhile, another pressing member 82 contacts a head holder 51B with a pressing portion 182*a*2 and a pressing portion 182*c*. In other words, the two pressing members 82 are separately provided for the head holders 51A and 51B.

The distance from the centroid OA of the head holder 51A to the reference shaft member 71 differs from the distance from the centroid OB of the head holder 51B to the reference shaft member 71. Hence, based on the distance from the reference shaft member 71 to each of the centroids OA and OB, the distance from the reference shaft member 71 to each of the pressing portion 182*a*1 and the pressing portion 182*b* in the head holder 51A is determined so as to differ from the distance from the reference shaft member 71 to each of the pressing portion 182*a*2 and the pressing portions 182*c* in the head holder 51B.

As a result, differences in weight and pressure between the head holders 51A and 51B can be balanced, thus allowing the reference shaft member 71 to receive uniform forces from the head holders 51A and 51B.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a plurality of recording heads, each recording head having a plurality of nozzles to eject liquid droplets;

plural head holders to hold the recording heads;

a carriage reciprocally movable in a main scanning direction and holding the plural head holders;

a guide member disposed along the main scanning direction to guide the carriage along the main scanning direction;

a reference member disposed parallel to the guide member in the carriage to rotatably hold the plural head holders; and a pressing unit to press the plural head holders toward the carriage, wherein the plural head holders are pressed against the reference member and the carriage by the pressing unit, and wherein each of the plural head holders is rotatable relative to the reference member.

2. The image forming apparatus of claim 1, wherein the plural head holders contact the reference member at at least two points and the head holder contacts the carriage at at least one point.

3. The image forming apparatus of wherein the head holder has a hook portion hooked on the reference member.

4. The image forming apparatus of claim 3, wherein the hook portion has two faces to contact the reference member.

5. The image forming apparatus of claim 1, wherein the carriage comprises a body and an intermediate member, the intermediate member is disposed between the head holder and the body and held by the body, and the head holder is pressed against the reference member and the intermediate member by the pressing unit.

6. The image forming apparatus of claim 1, wherein the plural head holders are pressed against the reference member and a body of the carriage by the pressing unit.

7. The image forming apparatus of claim 1, wherein the pressing unit has a pressing member to press the plural head holders against the reference member and the carriage, the pressing member has at least three pressing portions to contact the plural head holders, and when the pressing member presses the plural head holders, at least one of the at least three pressing portions is displaceable.

8. The image forming apparatus of claim 7, wherein, when the pressing member presses the plural head holders, at least another one of the at least three pressing portions is displaceable at an amount smaller than the at least one of the at least three pressing portions.

9. The image forming apparatus of claim 7, wherein the pressing member has an elastic member connecting the at least three pressing portions.

10. The image forming apparatus of claim 7, wherein the at least three pressing portions arc arranged in the main scanning direction, a central one of the at least three pressing portions at a central portion of the pressing member in the main scanning direction has a smallest displaceable amount of the at least three pressing portions, a distal one of the at least three pressing portions at each end of the pressing member in the main scanning direction is displaceable at an amount greater than the central one, and in a state in which the pressing member does not press the head holder, the distal one at the each end of the pressing member protrudes to a position closer to the head holder than the central one.

11. The image forming apparatus of claim 7, wherein the head holder comprises a plurality of head holders, and each of the plurality of head holders has a different distance from the reference member to each of the at least three pressing portions determined in accordance with a distance from the reference member to a centroid of the each of the plurality of head holders than at least another one of the plurality of head holders.

12. The image forming apparatus of claim 1, further comprising a position adjuster to hold each end of the reference member main scanning direction, wherein the position adjuster has a positioning face to position the reference member with respect to both a sub-scanning direction and a height direction.

13. The image forming apparatus of claim 12, wherein the position adjuster has a positioning face pressed against and contacting a rotation stopper to fix the position adjuster with respect to a rotation direction of the position adjuster.

14. The image forming apparatus of claim 1, wherein the pressing unit is rotatable around a rotation shaft, and the rotation shaft, the reference member, and a position at which the head holder contacts the carriage are arranged in this order from above to below.

15. The image forming apparatus of claim 1, wherein the pressing unit has a pressing face to press an upper face of one of the plural head holders.

* * * * *